US009622508B2

(12) United States Patent
Tanaka

(10) Patent No.: US 9,622,508 B2
(45) Date of Patent: Apr. 18, 2017

(54) METHOD FOR PREPARING FLAVOR-CONTAINING SHEET FOR SMOKING ARTICLE, FLAVOR-CONTAINING SHEET FOR SMOKING ARTICLE PREPARED BY THE METHOD, AND SMOKING ARTICLE COMPRISING THE SAME

(71) Applicant: JAPAN TOBACCO INC., Tokyo (JP)

(72) Inventor: Yasuo Tanaka, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 828 days.

(21) Appl. No.: 13/963,499

(22) Filed: Aug. 9, 2013

(65) Prior Publication Data

US 2013/0319430 A1 Dec. 5, 2013

Related U.S. Application Data

(63) Continuation of application No. PCT/JP2012/054826, filed on Feb. 27, 2012.

(30) Foreign Application Priority Data

Mar. 2, 2011 (JP) ..... 2011-045290

(51) Int. Cl.
*A24B 15/34* (2006.01)
*B05D 3/04* (2006.01)
(Continued)

(52) U.S. Cl.
CPC ..... *A24B 15/34* (2013.01); *A24B 3/12* (2013.01); *A24B 3/14* (2013.01); *A24B 15/10* (2013.01);
(Continued)

(58) Field of Classification Search
None
See application file for complete search history.

(56) References Cited

U.S. PATENT DOCUMENTS 4,596,259 A 6/1986 White et al.
5,186,185 A 2/1993 Mashiko et al.
(Continued)

FOREIGN PATENT DOCUMENTS

BR 9609628 A 4/1999
CN 1708241 A 12/2005
(Continued)

OTHER PUBLICATIONS

Korean Office Action for Korean Application No. 10-2013-7023164, dated Oct. 28, 2014, with a partial English translation.
(Continued)

*Primary Examiner* — Erma Cameron
(74) *Attorney, Agent, or Firm* — Birch, Stewart, Kolasch & Birch, LLP

(57) ABSTRACT

A method for preparing a flavor-containing sheet for a smoking article, characterized by includes a step of extending a raw material slurry on a substrate, wherein the slurry contains polysaccharide and a flavor, has a moisture content of 70 to 95 wt %, and has a temperature of 60 to 90° C. in a sol state, a step of cooling the extended raw material slurry to a sample temperature of 0 to 40° C. to form a gel, and a heat-drying step includes heating the gelled raw material and drying it at a sample temperature of 70 to 100° C.

8 Claims, 9 Drawing Sheets

(51) Int. Cl.

| | |
|---|---|
| ***A24B 3/12*** | (2006.01) |
| ***A24B 15/30*** | (2006.01) |
| ***B05D 3/02*** | (2006.01) |
| ***A24B 3/14*** | (2006.01) |
| ***A24B 15/28*** | (2006.01) |
| ***A24B 15/10*** | (2006.01) |
| ***A24D 1/00*** | (2006.01) |
| ***A24B 15/14*** | (2006.01) |

(52) U.S. Cl.

CPC ..... *A24B 15/14* (2013.01); *A24B 15/282* (2013.01); *A24B 15/301* (2013.01); *A24B 15/302* (2013.01); *A24B 15/303* (2013.01); *A24D 1/002* (2013.01); *B05D 3/02* (2013.01); *B05D 3/0254* (2013.01); *B05D 3/0426* (2013.01)

(56) References Cited

U.S. PATENT DOCUMENTS

| | | | | |
|---|---|---|---|---|
| 6,109,272 | A | 8/2000 | Saito et al. | |
| 2004/0129280 | A1 | 7/2004 | Woodson et al. | |
| 2005/0039767 | A1 | 2/2005 | Mua et al. | |
| 2005/0244521 | A1 | 11/2005 | Strickland et al. | |
| 2007/0246054 | A1 | 10/2007 | Gedevanishvili et al. | |
| 2008/0011311 | A1 | 1/2008 | Ojima et al. | |
| 2011/0036367 | A1 | 2/2011 | Saito et al. | |
| 2011/0061667 | A1 | 3/2011 | Tanaka et al. | |
| 2011/0139164 | A1* | 6/2011 | Mua | A24B 3/14 131/111 |
| 2011/0220130 | A1* | 9/2011 | Mua | A24B 13/00 131/111 |
| 2013/0019884 | A1 | 1/2013 | Sashide et al. | |
| 2013/0319430 | A1 | 12/2013 | Tanaka | |
| 2013/0327346 | A1 | 12/2013 | Tanaka et al. | |
| 2013/0327347 | A1 | 12/2013 | Tanaka et al. | |

FOREIGN PATENT DOCUMENTS

| | | | |
|---|---|---|---|
| CN | 101374429 | A | 2/2009 |
| EP | 0 135 266 | A | 11/1988 |
| EP | 2279677 | A1 | 2/2011 |
| EP | 2 289 357 | A1 | 3/2011 |
| JP | 64-27461 | A | 1/1989 |
| JP | 4-75578 | A | 3/1992 |
| JP | 9-28366 | A | 2/1997 |
| JP | 11-509566 | A | 8/1999 |
| JP | 2001-231468 | A | 8/2001 |
| JP | 3212271 | B2 | 9/2001 |
| JP | 4109804 | B2 | 7/2008 |
| JP | 5514952 | B2 | 6/2014 |
| JP | 5514953 | B2 | 6/2014 |
| KR | 10-0904333 | B1 | 6/2009 |
| TW | 201016148 | A1 | 5/2010 |
| TW | 201240613 | A1 | 10/2012 |
| TW | 201240614 | A1 | 10/2012 |
| WO | WO 97/02759 | A1 | 1/1997 |
| WO | WO 2006/023281 | A2 | 3/2006 |
| WO | WO 2009/142159 | A1 | 11/2009 |
| WO | WO 2009/157240 | A1 | 12/2009 |

OTHER PUBLICATIONS

Korean Office Action for Korean Application No. 10-2013-7023165, dated Oct. 31, 2014, with an English translation.
Korean Office Action for Korean Application No. 10-2013-7023185, dated Oct. 31, 2014, with an English translation.
Taiwanese Office Action for Taiwanese Application No. 101106671, dated Oct. 28, 2014, with an English translation.
Chinese Office Action dated Jan. 11, 2016, for Chinese Application No. 201280019134.7 with the English translation.
Malaysia Office Action dated Nov. 30, 2015 for corresponding Application No. PI 2013701424.
Malaysia Office Action dated Nov. 30, 2015 for corresponding application No. PI.2013701423.
Chinese Office Action for Chinese Application No. 201280019148.9, dated Feb. 16, 2016, with an English translation.
Chinese Office Action, dated Mar. 4, 2016, for Chinese Application No. 201280019136.6 , along with an English translation.
European Office Action, dated Jun. 16, 2016, for European Application No. 12 751 885.0.
European Office Action, dated Jun. 16, 2016, for European Application No. 12 752 507.9.
European Office Action, dated Jun. 16, 2016, for European Application No. 12 752 746.3.
International Search Report issued in PCT/JP2012/054826, mailed on Jun. 5, 2012.
PCT/ISA/237—Mailed on Jun. 5, 2012, issued in PCT/JP2012/054826.
China Office Action for No. 201280019134.7 dated Jun. 1, 2015.
China Office Action for No. 201280019148.9 dated Jun. 11, 2015.
Chinese Office Action and Search Report, dated Jul. 3, 2015, for Chinese Application No. 201280019136.6, with English translation thereof.
Agargel XP-002727227, pp. 1-2, from Internet on Jul. 28, 2014.
CPKelco, GENU Carrageenan Book XP-002727226.
Kochumalayil et al., Tamarind seed xyloglucan—a thermostable high-performance biopolymer from non-food feedstock XP 002727189 Journal of Materials Chemistry, vol. 20, Apr. 27, 2010, pp. 4321-4327.
Miyoshi et al., "Rheological and thermal studies of gel-sol transition in gellan gum aqueous solutions" XP-002727190 Carbohydrate Polymers, vol. 30, 1996, pp. 109-119.
Nishinari et al., XP-002727188 "Rheological and related study of gelation of xyloglucan in the presence of small molecules and other polysaccharides" Cellulose August, vol. 13, No. 4, Aug. 2006, pp. 365-374.
Nitta et al., "Synergistic Gel Formation of Xyloglucan/Gellan Mixtures as Studied by Rheology, DSC, and Circular Dichroism" XP-002727187 Biomacromolecules, vol. 4., No. 6, Nov. 2003, pp. 1654-1660.
Nitta et al., XP055097026 "Gelation and gel properties of polysaccharides gellan gum and tamarind xyloglucan", Journal of biological macromolecules, Nov. 1, 2005, pp. 47-52.
International Preliminary Report on Patentability for PCT/JP2012/054826 dated Sep. 3, 2013.
International Preliminary Report on Patentability for PCT/JP2012/054827 dated Sep. 3, 2013.
International Preliminary Report on Patentability for PCT/JP2012/054828 dated Sep. 3, 2013.
Taiwanese Office Action for Taiwanese Application No. 101106668, dated Oct. 28, 2014, with an English translation.
Office Action issued in copending U.S. Appl. No. 13/963,821, mailed on Feb. 19, 2016.
China Light Industry Press, "Food Thickener" 2nd editition, Jan. 2009.
Chinese Office Action for corresponding Application No. 201280019134.7 mailed Jul. 19, 2016.
Notice of Allowance in co-pending U.S. Appl. No. 13/963,653 dated Aug. 17, 2016.
Notice of Allowance in co-pending U.S. Appl. No. 13/963,821 dated Oct. 6, 2016.
Chinese Office Action issued on Sep. 1, 2016 in corresponding application, together with English language translation.
Chinese Office Action issued on Sep. 5, 2016 in corresponding application, together with English language translation.
Guohua "Functional Food Gel", Chemical Industries Publishing Co., Jan. 2004, pp. 242-243.

* cited by examiner

METHOD FOR PREPARING FLAVOR-CONTAINING SHEET FOR SMOKING ARTICLE, FLAVOR-CONTAINING SHEET FOR SMOKING ARTICLE PREPARED BY THE METHOD, AND SMOKING ARTICLE COMPRISING THE SAME

CROSS REFERENCE TO RELATED APPLICATIONS

This application is a Continuation Application of PCT Application No. PCT/JP2012/054826, filed Feb. 27, 2012 and based upon and claiming the benefit of priority from prior Japanese Patent Application No. 2011-045290, filed Mar. 2, 2011, the entire contents of all of which are incorporated herein by reference.

BACKGROUND OF THE INVENTION

1. Field of the Invention

The present invention relates to a method for preparing a flavor-containing sheet used for a smoking article, a flavor-containing sheet for a smoking article prepared by the method, and a smoking article comprising the same.

2. Description of the Related Art

If a volatile flavor component such as menthol is added to cut tobacco in a solution state, the flavor component is dissipated in a long-term storage and the flavor effect does not last. In order to solve such a problem, various reports have been made.

Patent Documents 1 and 2 disclose that a flavor component is placed in the filter part of a cigarette with the flavor component coated with a natural polysaccharide to suppress the volatilization and dissipation of the flavor component; and the coated favor component is crushed by pressing it to release the flavor at the time of smoking. Patent Document 3 discloses that a flavor component is placed in the filter part of a cigarette with the flavor component coated with a water-soluble matrix such as dextrin to suppress the volatilization and dissipation of the flavor component; and the water-soluble matrix is dissolved by the moisture in the mainstream smoke to release the flavor at the time of smoking. Thus, when the flavor component is placed in the filter part which is a non-burning part of the cigarette, there is a time lag until the flavor is tasted because the flavor is released by pressing the filter part at the time of smoking or dissolving the water-soluble matrix by the moisture in the mainstream smoke.

On the other hand, Patent Documents 4 to 6 report an example in which a flavor component is placed in a burning part, that is, cut tobacco or a cigarette paper which wraps it.

Patent Document 4 discloses that a cigarette paper which wraps tobacco filler is coated with a flavor material in which the flavor component is incorporated into the three-dimensional network of the glucan molecules. The cigarette of Patent Document 4 has a good flavor-retaining property since the flavor component is fixed and retained with incorporated into the three-dimensional network of the glucan molecules. However, the flavor component is present in the glucan molecules in a relatively small amount (20 wt % or less). Accordingly, in the case of the flavor component which requires a relatively large amount to be added, such as menthol, the blending amount of the flavor material to the cigarette becomes high.

Patent Document 5 discloses that "a stabilized flavor substance which is stable up to 180° C." is prepared by mixing a liquid flavor with a carrageenan sol; dropping the mixture into an ionic solution (a solution containing potassium ions) to prepare a particulate gel; and drying the gel in the air. However, the method of Patent Document 5 requires long periods of time and large facilities in order to prepare a large amount of the material because the granular gel is dried in the air.

Patent Document 6 reports that a sheet containing a flavor component with coated with a gel of polysaccharide is produced by drying a slurry containing the flavor component such as menthol and the polysaccharide; and the sheet is cut and the cut pieces is added to cut tobacco. According to the report, it takes a week to dry the slurry at 40° C.

PRIOR ART DOCUMENT

Patent Document

Patent Document 1: Jpn. Pat. Appln. KOKAI Publication No. 64-27461

Patent Document 2: Jpn. Pat. Appln. KOKAI Publication No. 4-75578

Patent Document 3: International Publication No. 2009-157240

Patent Document 4: Jpn. Pat. Appln. KOKAI Publication No. 9-28366

Patent Document 5: Jpn. PCT National Publication No. 11-509566

Patent Document 6: International Publication No. 2009-142159

BRIEF SUMMARY OF THE INVENTION

Problem to be Solved by the Invention

The present inventors have simply increased the drying temperature in order to prepare a menthol-containing sheet in a shorter time as a flavor-containing material used for a smoking article, particularly a cigarette. In this case, the present inventors have encountered problems in which the obtained sheet has a low menthol content and a low menthol yield and the menthol content is reduced after storage.

Therefore, an object of the present invention is to provide a method for preparing a flavor-containing sheet for a smoking article in a shorter time wherein the sheet has a high flavor content, a high flavor yield, and a high post-storage flavor-retaining property when incorporated into the smoking article. Further, an object of the present invention is to provide a flavor-containing sheet for a smoking article which has a high post-storage flavor-retaining property when incorporated into the smoking article and can be prepared in a shorter time.

Means for Solving the Problem

The present inventors have studied in order to solve the problems. As a result, they have found that even if a high drying temperature is employed which enables the drying of the flavor-containing sheet in a shorter time, it is possible to prepare a flavor-containing sheet which has a high flavor content and a high flavor yield and maintains the high flavor content even after storage, by cooling the sheet once before heat-drying and then drying it (preferably, initial drying is performed at a high temperature, and late drying is performed at a temperature lower than that of the initial drying). Thus, they have completed the present invention.

That is, according to an aspect of the present invention, there is provided a method for preparing a flavor-containing sheet for a smoking article, characterized by comprising: a step of extending a raw material slurry on a substrate, wherein the slurry contains polysaccharide and a flavor such as menthol, has a moisture content of 70 to 95 wt %, and has a temperature of 60 to 90° C. in a sol state; a step of cooling the extended raw material slurry to a sample temperature of 0 to 40° C. to form a gel; and a heat-drying step comprising heating the gelled raw material and drying it at a sample temperature of 70 to 100° C.

According to a preferred embodiment, the heat-drying step is performed so that the sample keeps the sample temperature at 100° C. or less during the whole period of the step.

According to a preferred embodiment, the heat-drying step is performed so that the raw material is dried to form a sheet having a moisture content of less than 10% for a total heat-drying time of 20 minutes or less.

According to a preferred embodiment, the heat-drying step is performed so that the raw material is dried to form a sheet having a moisture content of less than 10% for a total heat-drying time of 20 minutes or less, by performing initial drying for a quarter or more of the total heat-drying time by blowing the hot air of 100° C. or more on the gelled raw material and performing the latter drying for a quarter or more of the total heat-drying time by blowing the hot air less than 100° C. on the gelled raw material.

According to another aspect of the present invention, there is provided a flavor-containing sheet for a smoking article, characterized in that it is prepared by the above-mentioned method.

According to another aspect of the present invention, there is provided a smoking article comprising cut tobacco, characterized in that cut pieces of the above-mentioned flavor-containing sheet for a smoking article are blended with the cut tobacco.

Effects of the Invention

According to the method for preparing a flavor-containing sheet for a smoking article of the present invention, it is possible to prepare a flavor-containing sheet for a smoking article in a shorter time wherein the sheet has a high flavor content, a high flavor yield, and a high post-storage flavor-retaining property when incorporated into the smoking article. Further, the flavor-containing sheet for a smoking article of the present invention has a high post-storage flavor-retaining property when incorporated into the cigarette and can be prepared in a shorter time.

DETAILED DESCRIPTION OF THE INVENTION

Figure 1:
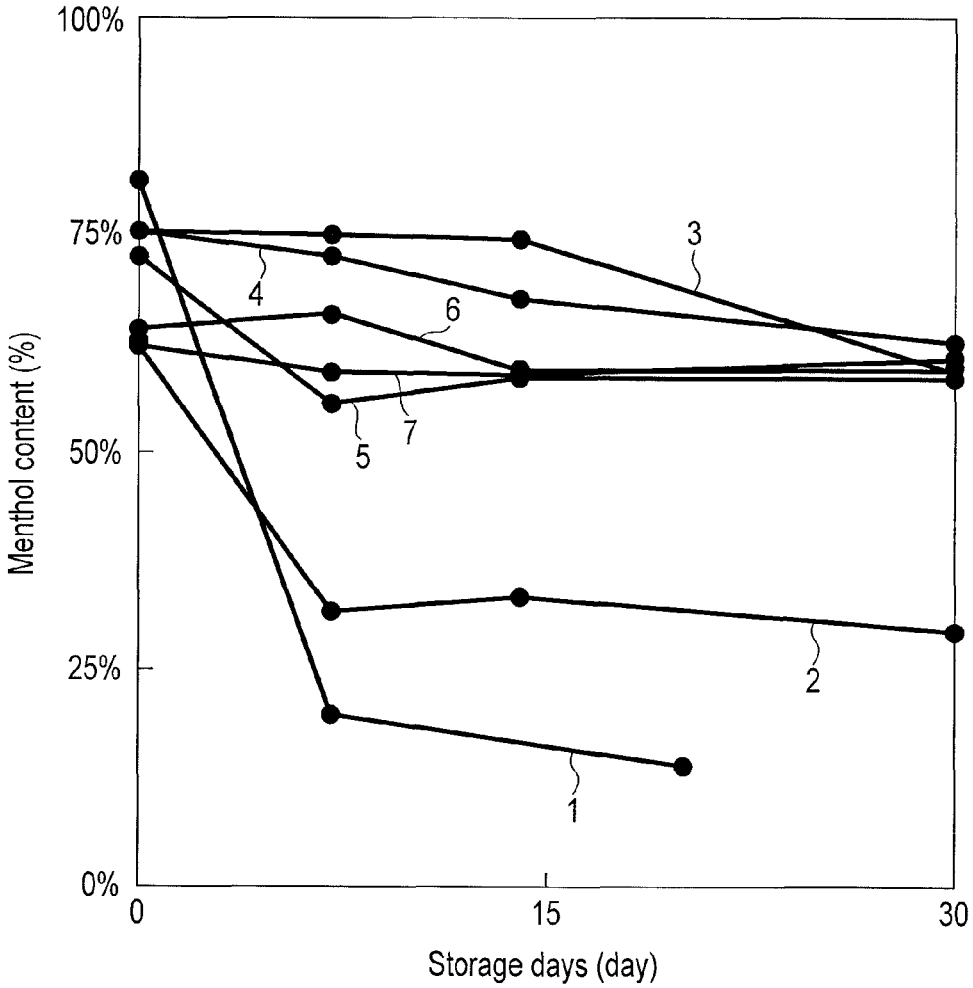
FIG. 1 is a graph showing the menthol content of menthol-containing sheets after storage periods.

The present invention will be explained below. The following explanations are intended to describe the present invention in detail, and are not intended to limit the present invention.

A flavor contained in the flavor-containing sheet of the present invention is not limited as long as it is used for a smoking article. Any type of flavor can be used. Main examples of the flavor include menthol, leaf tobacco extract; natural plant flavors (e.g., cinnamon, sage, herb, chamomile, kudzu (Pueraria lobata), hydrangeae dulcis folium, clove, lavender, cardamom, caryophyllus, nutmeg, bergamot, geranium, honey essence, rose oil, lemon, orange, cassia bark, caraway, jasmine, ginger, coriander, vanilla extract, spearmint, peppermint, cassia, coffee, celery, cascarilla, sandalwood, cocoa, ylang ylang, fennel, anise, licorice, St John's bread, prune extract, and peach extract); saccharides (e.g., glucose, fructose, isomerized saccharide, and caramel); cocoa (e.g., powder and extract); esters (e.g., isoamyl acetate, linalyl acetate, isoamyl propionate, and linalyl butyrate); ketones (e.g., menthone, ionone, damascenone, and ethyl maltol); alcohols (e.g., geraniol, linalool, anethole, and eugenol); aldehydes (e.g., vanillin, benzaldehyde, and anisaldehyde); lactones (e.g., γ-undecalactone and γ-nonalactone); animal flavors (e.g., musk, ambergris, civet, and castoreum); and hydrocarbons (e.g., limonene and pinene). A flavor which easily forms a dispersion state in a solvent by addition of an emulsifier, such as a hydrophobic flavor and oil-soluble flavor may be preferably used. Such a flavor may be used alone or in combination.

Hereinafter, the present invention will be explained with an example where menthol is used as a flavor.

1. Menthol-Containing Sheet for Smoking Article

In an embodiment of the present invention, a menthol-containing sheet for a smoking article (hereinafter referred to as "menthol-containing sheet") is prepared by the method comprising:

a step of extending a raw material slurry on a substrate, wherein the slurry contains polysaccharide and menthol, has a moisture content of 70 to 95 wt %, and has a temperature of 60 to 90° C. in a sol state;

a step of cooling the extended raw material slurry to a sample temperature of 0 to 40° C. to form a gel; and a heat-drying step comprising heating the gelled raw material and drying it at a sample temperature of 70 to 100° C.

The term "sample temperature" used herein means a temperature on the surface of a sample (i.e., a slurry or a sheet).

In a preferred embodiment, the heat-drying step is performed so that the raw material is dried to form a sheet having a moisture content of less than 10% for a total heat-drying time of 20 minutes or less, by performing initial drying for a quarter or more of the total heat-drying time by blowing the hot air of 100° C. or more on the gelled raw material and performing the latter drying for a quarter or more of the total heat-drying time by blowing the hot air less than 100° C. on the gelled raw material.

(1) Preparation of Raw Material Slurry

In the present invention, the raw material slurry can be prepared by a method comprising: (i) a step of mixing polysaccharide with water and heating the mixture to prepare an aqueous solution of the polysaccharide; and (ii) a step of adding menthol and an emulsifier to the aqueous solution and kneading and emulsifying the mixture.

Specifically, the step (i) can be performed by adding polysaccharide to water in small amounts to dissolve it in water while stirring. The heating temperature in the step may be from 60 to 90° C., preferably from 75 to 85° C. The step (ii) can be performed by any known emulsification techniques using a homogenizer since the raw material slurry has a viscosity of about 10,000 mPas (sol state), which does not interfere with the emulsification, at the above heating temperature.

The composition of the raw material slurry can be as follows: for example, 200 to 500 g of polysaccharide, 1000 to 2500 g of menthol, and 80 to 200 mL of a solution containing 2 to 10 wt % of an emulsifier, per 10 L of water. The moisture content of the raw material slurry is from 70 to 95 wt %, preferably from 80 to 90 wt %. The ratio (weight ratio) of polysaccharide and menthol in the raw material slurry may be in a range of 1:1 to 1:10.

In the present invention, the polysaccharide has a property of fixing micelle of menthol to coat it, by forming gel when cooling once after heating. The polysaccharide is preferably a natural thickening polysaccharide. For example, it is a single-component system such as carrageenan, agar or gellan gum; or a combined system of a combination of carrageenan, agar or gellan gum with at least one component selected from the group consisting of locust bean gum, guar gum, tamarind gum, xanthan gum, tara gum, konjak glucomannan, cassia gum, and psyllium seed gum.

In the present invention, 1-menthol may be used as menthol.

In the present invention, a naturally occurring emulsifier such as lecithin, specifically, SUN LECITHIN A-1 (Taiyo Kagaku Co., Ltd.), may be used as the emulsifier.

(2) Extension of Raw Material Slurry on Substrate

The prepared raw material slurry having a temperature of 60 to 90° C. is extended on a substrate.

The raw material slurry can be extended by extruding the raw material slurry on the substrate with a casting gate or through a slit die. As the substrate, any type of substrate may be used, as long as the menthol-containing sheet prepared by dry-forming can be peeled off from the substrate. For example, a polyethylene terephthalate (PET) film (FE2001, FUTAMURA CHEMICAL CO., LTD.) may be used. The raw material slurry can be extended so that the thickness after drying becomes about 0.1 mm, which is equal to the thickness of normal cut tobacco.

(3) Cooling Before Dry-Forming of Slurry

In the preparation of the menthol-containing sheet of the present invention, the extended raw material slurry is once cooled before drying so that the slurry becomes a temperature enabling sufficient gelation of the slurry (40° C. or less) and avoiding breaking of emulsion due to freezing (0° C. or more), i.e., a temperature of 0 to 40° C., preferably 0 to 30° C., and more preferably 15 to 25° C. The raw material slurry before cooling has a temperature of 60 to 90° C., preferably a temperature of 75 to 85° C., and is in a sol state. The preliminary cooling may be performed by blowing the air or the cold air (e.g., 10° C.) generated by a spot cooler (e.g., Suiden SS-25DD-1) on the extended raw material slurry for 2 to 3 minutes. Alternatively, the preliminary cooling may be performed by contacting the extended raw material slurry with a tube through which the cooling medium (e.g., 10° C.) generated by a chilled water generator (a chiller, for example, APISTE PCU-1600R) is running, for 1 to 2 minutes. Alternatively, the preliminary cooling may be performed by allowing the extended raw material slurry to stand at room temperature.

As shown in Example 4 below, once a solution of the polysaccharide listed above is cooled and forms gel, the solution has a property of being capable of maintaining the gel state without easily returning to a sol state even at the gel transition temperature even if the temperature is raised afterward. The above property is utilized in the present invention, and the preliminary cooling is performed before drying the raw material slurry. As a result, the polysaccharide contained in the raw material slurry after the preliminary cooling is hard to solate even if the temperature is raised at the time of drying, and the menthol coated with the polysaccharide is hard to volatilize. This is demonstrated in the present invention.

When the raw material slurry is extended on the substrate and cooled once, it is advantageous in that the extended raw material slurry is hard to deform even if it is exposed to high temperatures in the subsequent drying step.

Figure 4A:
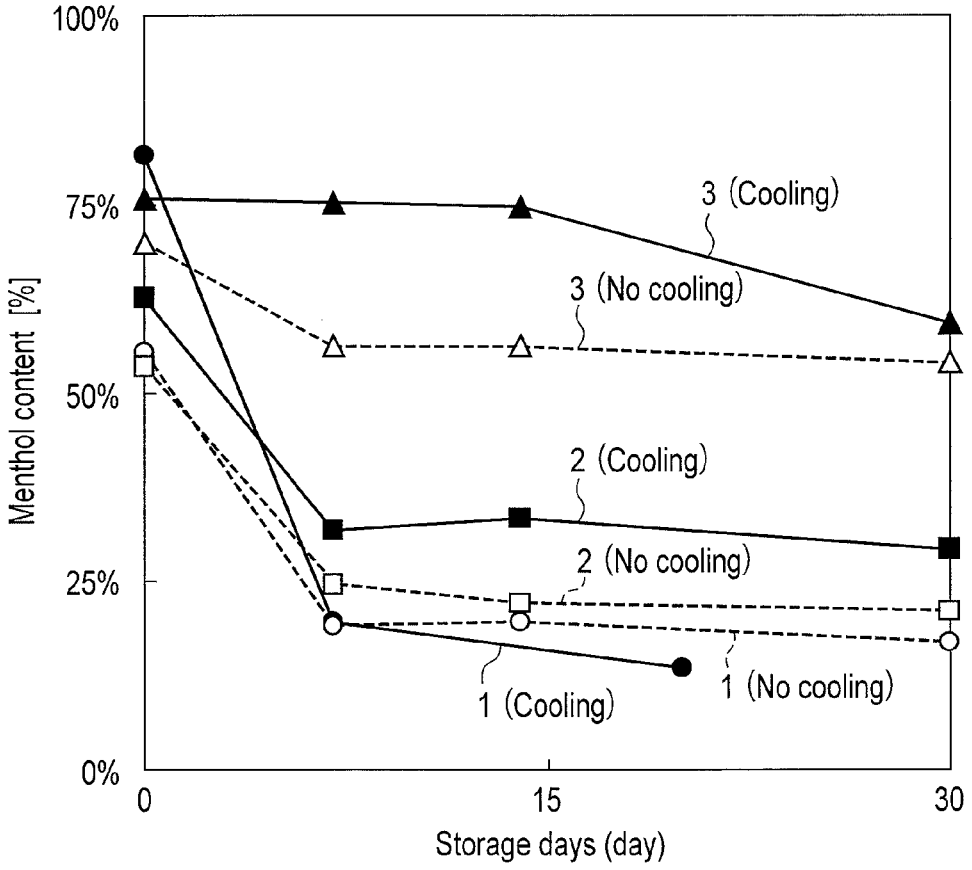
FIG. 4A is a graph showing cooling effects on the post-storage menthol content of the menthol-containing sheets (comparative examples).
Figure 4B:
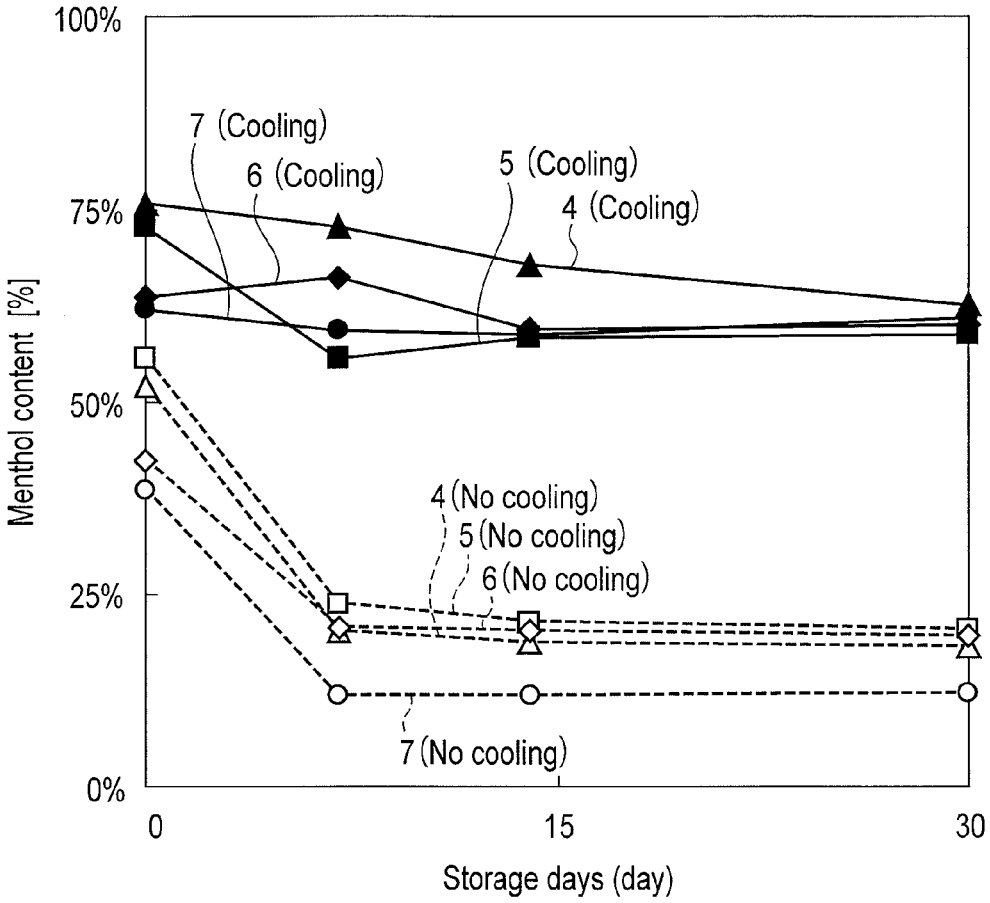
FIG. 4B is a graph showing cooling effects on the post-storage menthol content of the menthol-containing sheets (examples of the present invention).
Figure 5:
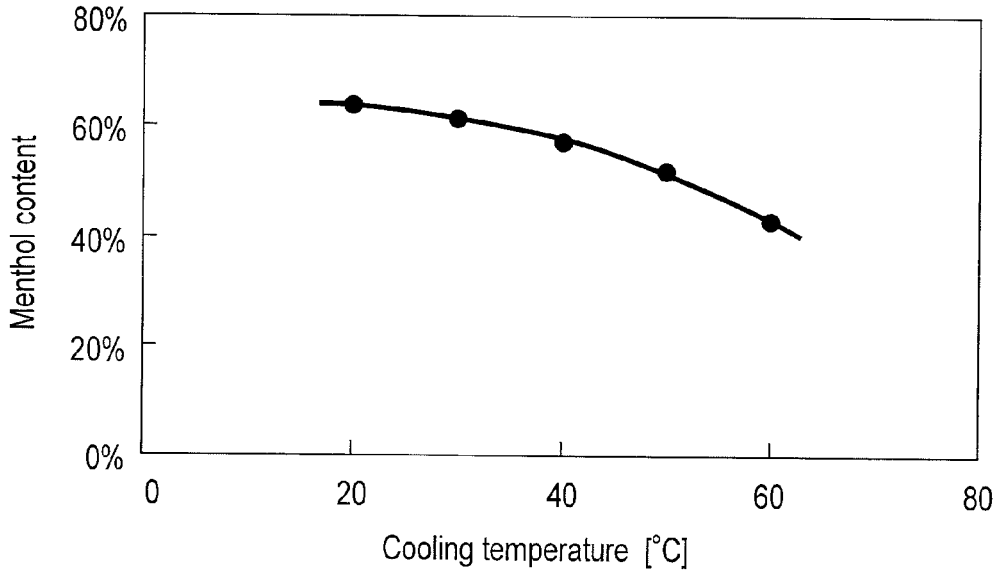
FIG. 5 is a graph showing a relationship between the cooling temperature and the menthol content of the menthol-containing sheets.

The cooling effect on the post-storage flavor-retaining property of the flavor-containing sheet is demonstrated in Example 6 below (FIG. 4B). Lower cooling temperatures result in larger contents of menthol, which is demonstrated in Example 7 below (FIG. 5).

(4) Dry Forming of Slurry

The heat-drying of the extended and cooled raw material slurry can be performed by any type of heat-drying means such as a hot air drying or an infrared heat drying. Hereinafter, the "heat-drying" of the raw material slurry is simply referred to as "drying".

In the present invention, the drying of the raw material slurry includes drying by heating the cooled raw material slurry at a sample temperature of 70 to 100° C. Preferably, the sample temperature is 100° C. or less over the total drying time.

The term "sample temperature" means a temperature on the surface of a sample (i.e., a slurry or a sheet). The term "total drying time" means a period to be heated in a heat-dryer. The total drying time is generally 20 minutes or less, preferably from 7 to 20 minutes, more preferably from 10 to 18 minutes.

In the present invention, the sample temperature may be less than 70° C. during the drying step. However, in order to shorten the drying time, it is preferable to short the period when the sample temperature is less than 70° C. In present invention, the sample temperature may exceed 100° C.

during the drying step. However, in order to stably maintain the flavor, it is preferable to short the period when the sample temperature exceeds 100° C. Therefore, the drying of the raw material slurry can be preferably performed by drying the cooled raw material slurry at a sample temperature of 70 to 100° C. for more than one-half of the total drying time. Preferably, the sample temperature is 100° C. or less over the total drying time. More preferably, the drying of the raw material slurry can be performed by drying the cooled raw material slurry at a sample temperature of 70 to 100° C. over the total drying time.

However, immediately after the heat-drying is started, the temperature of the sample in the heat-dryer is in the middle of increasing from the preliminary cooling temperature to a desired sample temperature (70° C.) and does not reach the desired sample temperature. When expressed as "at a sample temperature of 70 to 100° C. over the total drying time", the term "total drying time" means a total drying time excluding the beginning period when the sample temperature is in the middle of increasing to the desired sample temperature. For example, in Example 5 (FIGS. 3A to 3G) below, the sample temperature is in the middle of increasing to the desired sample temperature for about 1 minute after the start of heat-drying. Thus, the beginning period is excluded from the "total drying time", when expressed as "at a sample temperature of 70 to 100° C. over the total drying time".

Preferably, the drying of the raw material slurry can be performed by drying the raw material slurry so that a sheet form having a moisture content of less than 10% is prepared for a total drying time of 20 minutes or less.

In Example 5 below (FIGS. 3D to 3G), it is demonstrated that when the raw material slurry is dried at the above sample temperature, the sheet obtained by the drying can achieve a high post-storage flavor-retaining property.

Hereinafter, the case of hot air drying will be explained. In the case of hot air drying, in order to maintain a sample temperature of 70 to 100° C., the raw material slurry is preferably dried with hot air having a temperature of 100° C. or more at the time of initial drying, and then, with hot air having the same temperature as the initial drying or a temperature lower than the initial drying (preferably 70° C. or more and less than 100° C.). Accordingly, it is possible to suppress the sample temperature rise in the latter drying. For example, it is possible to keep the sample temperature so as not to exceed 100° C. over the total drying time.

In the present invention, it is possible that the prepared menthol-containing sheet has a high menthol content and a high yield of menthol, and maintains a high menthol content after storage, once the raw material slurry is cooled even if the subsequent drying step includes a drying process in which the sample temperature reaches 70 to 100° C. (e.g., high temperature drying with hot air having a temperature of 100° C. or more).

In the case of hot air drying, the hot air temperature may be a constant temperature in the whole period of the drying step or may be changed in the period of the drying step. When the hot air temperature is changed, the drying of the raw material slurry is preferably performed by the initial drying at a high temperature with hot air having a temperature of 100° C. or more and the latter drying at a low temperature with hot air having a temperature of less than 100° C. The term "initial drying" used herein means the first drying in the drying step with hot air having a temperature of 100° C. or more, and the term "latter drying" means the drying followed by the initial drying, with hot air having a low temperature of less than 100° C. Thus, if the initial drying with hot air having a high temperature is performed in combination with the latter drying with hot air having a low temperature, it is advantageous in that the sample temperature does not become too high. In the case of hot air drying, the temperature in the dryer is the same as the hot air temperature.

More preferably, the raw material slurry can be dried so that a sheet form having a moisture content of less than 10% is prepared for a total drying time of 20 minutes or less, by performing the initial drying at a hot air temperature of 100° C. or more for a quarter or more of the total drying time and then the latter drying at a hot air temperature of less than 100° C. for a quarter or more of the total drying time.

Thus, if the initial drying with hot air having a high temperature is performed in combination with the latter drying with hot air having a low temperature, it is possible to suppress the sample temperature rise in the latter drying. For example, it is possible to keep the sample temperature so as not to exceed 100° C. Accordingly, it is possible that the menthol-containing sheet of the present invention has a high menthol content after the sheet preparation and also maintains a high menthol content after storage (see Sample No. 4 of Example 1, Sample No. 5 of Example 2, and Sample No. 6 of Example 3 below).

When the raw material slurry is dried by hot air drying, the initial drying can be performed, for example, with hot air having a temperature of 100 to 130° C. for 4 to 6 minutes, and the latter drying can be performed, for example, with hot air having a temperature of 70° C. or more and less than 100° C. for 4 to 6 minutes. The air volume of hot air may be set to, for example, 3 to 20 m/sec. The total drying time is generally 20 minutes or less, preferably from 7 to 20 minutes, more preferably from 10 to 18 minutes.

The conditions of the initial drying and the latter drying (temperature, time, and air volume) can be appropriately set, for example, within the above range. For example, the initial drying is performed at a hot air temperature of 100 to 130° C. until the moisture of the surface of the raw material slurry is evaporated and a film is sufficiently formed on the surface of the slurry. Thereafter, the hot air temperature is immediately changed to a range of 70° C. or more and less than 100° C., and the latter drying can be performed.

The hot air temperature during the initial drying may be constant, or may be changed so as to sequentially decrease within a range of 100 to 130° C. The hot air temperature during the latter drying may be constant, or may be changed so as to sequentially decrease within a range of 70° C. or more and less than 100° C. For example, the hot air drying machine used in Examples below has three drying chambers and each sample is conveyed in the order of the first, second, and third chambers by a belt conveyor. Thus, the first and second chambers may be used for the initial drying at the same or different temperatures (100° C. or more) and the third chamber may be used for the latter drying (less than 100° C.). Alternatively, the first chamber is used for the initial drying (100° C. or more) and the second and third chambers may be used for the latter drying at the same or different temperatures (less than 100° C.)

In the present invention, the drying is performed until the menthol-containing sheet is sufficiently dried so that the sheet can be easily peeled off from a substrate and can be cut in the subsequent cutting step. Specifically, the drying is performed until the moisture content of the menthol-containing sheet reaches less than 10 wt %, preferably from 3 to 9 wt %, more preferably from 3 to 6 wt % (see Example 8 below). The term "moisture content" used herein means a value measured according to the measurement method described in the following examples.

Immediately after the preparation, the menthol content of the menthol-containing sheet of the present invention is preferably 45 wt % or more, more preferably from 55 to 75 wt %. After storage (at 50° C. for 30 days), the menthol content of the menthol-containing sheet of the present invention is preferably 45 wt % or more, more preferably from 48 to 63 wt %. The term "menthol content" used herein means a value measured according to the measurement method described in the following examples.

2. Smoking Article

The menthol-containing sheet of the present invention is cut into, for example, a size equal to that of normal cut tobacco, and thus the cut pieces can be blended with cut tobacco for the smoking article. The cut pieces of the menthol-containing sheet can be added in an amount of 2 to 10 g per 100 g of cut tobacco. The cut pieces of the menthol-containing sheet is preferably dispersed in the cut tobacco and blended with it.

The menthol-containing sheet of the present invention can be blended with cut tobacco of any type of smoking articles, for example, a burning type smoking article in which a smoker tastes the flavor of smoke by burning the tobacco leaves, particularly a cigarette. Particularly, the menthol-containing sheet of the present invention can be blended with cut tobacco of a cigarette comprising a cigarette rod which includes cut tobacco and a cigarette paper wrapped around the cut tobacco.

EXAMPLES

Example 1

(1) Preparation of Raw Material Slurry (10 L Scale)

Water 10 L

Gellan gum (KELCOGEL, San-Ei Gen F.F.I., Inc.) 150 g

Tamarind gum (BISTOP D-2032, San-Ei Gen F.F.I., Inc.) 150 g

Lecithin (SUN LECITHIN A-1, Taiyo Kagaku Co., Ltd.) 120 mL (5% aqueous solution)

Menthol (Takasago International Corporation.) 1500 g

Water (10 L) was kept at 80° C., and gellan gum (150 g) and tamarind gum (150 g) were added and dissolved therein in small portions so as not to form lumps (the time required: about 20 minutes), while stirring them with a mixer (PRIMIX T.K. AUTO MIXER Model 40/equipped with a rotor for stirring a solution/2000 rpm), and menthol (1500 g) was added.

The stirring mixer was replaced with a homogenizer (PRIMIX T.K. AUTO MIXER Model 40/equipped with a rotor-stator head/4000 rpm) and the mixture was emulsified for 10 minutes. Then, lecithin (120 mL of 5% aqueous solution) was added thereto, followed by emulsification for 10 minutes to prepare a raw material slurry.

(2) Dry Forming

The obtained raw material slurry was extruded on a base film through a slit die. After that, the cold air generated by a spot cooler (Suiden SS-25DD-1) (10° C.) was blown on the raw material slurry for 2 to 3 minutes so that the raw material slurry was cooled to about 20° C. After that, it was dried with hot air by carrying it on the belt conveyor in the hot-air drying machine to obtain a menthol-containing sheet in film form. The details of the experiment will be described below.

Slit die: vertical slit die (which was heated at 60° C. and kept warm), 900 μm in thickness and 20 cm in width Base film: PET film (which was surface corona treated), 50 μm in thickness Hot air drying machine: hot air type of a dry forming machine having the following configuration Drying compartment: three chambers (each zone length: 2.5 m, total length: 7.5 m)

Air volume and form of hot air:

First chamber: perforated plate, air volume: 5 m/sec.

Second chamber: perforated plate, air volume: 10 m/sec.

Third chamber: floating jet, air volume: 20 m/sec.

In the first and second chambers, hot air was blown on the menthol-containing sheet which was conveyed on the belt, through a perforated plate which functions as a flow control plate. In the third chamber, hot air was blown on the menthol-containing sheet which was conveyed while floating together with a base film by upward and downward ventilation.

The hot air drying conditions were changed as described in Table 1 below to prepare menthol-containing sheets of Sample Nos. 1 to 4. The temperature described in the table are hot air temperature. The drying time was set so that the menthol-containing sheet was sufficiently dried, can be easily peeled off from the base film, and can be cut in the subsequent cutting step. The moisture content of the menthol-containing sheets obtained in this example was about 3%.

(3) Measurement of Dry State of Menthol-Containing Sheet

The moisture content of the menthol-containing sheet was measured by the GC-TCD as follows.

0.1 g of a menthol-containing sheet (cut into 1×10 mm pieces) was weighed. 10 mL of methanol (a new reagent of special grade or higher grade was dispensed without exposing it to the air to eliminate the influence of the water absorption in the air) was added to the cut pieces in a 50 mL closed container (screw tube), followed by shaking at 200 rpm for 40 minutes. The resulting mixture was left overnight, shaken again at 200 rpm for 40 minutes, and allowed to stand. The supernatant was used as a measurement solution (without diluting for the GC measurement).

The measurement solution was analyzed by the GC-TCD and quantified by the calibration curve method.

GC-TCD; 6890 gas chromatograph, manufactured by Hewlett Packard

Column; HP Polapack Q (packed column) Constant Flow mode 20.0 mL/min

Injection; 1.0 μL

Inlet; EPC purge packed column inlet

Heater; 230° C.

Gas; He

Total flow; 21.1 mL/min

Oven; 160° C. (hold 4.5 min)→(60° C./min)→220° C. (hold 4.0 min)

Detector; TCD detector Reference gas (He) flow rate; 20 mL/min Make up gas (He) 3.0 mL/min Signal rate; 5 Hz Concentrations of calibration curve solutions; six points of 0, 1, 3, 5, 10 and 20 [mg-H2O/10 mL]

(4) Measurement of Menthol Content of Menthol-Containing Sheet

The menthol content of menthol-containing sheets was measured with GC-FID in the following manner.

0.1 g of a menthol-containing sheet (cut into 1×10 mm pieces) was weighed. 10 mL of methanol (a new reagent of special grade or higher grade was dispensed without exposing it to the air to eliminate the influence of the water absorption in the air) was added to the cut pieces in a 50 mL closed container (screw tube), followed by shaking at 200 rpm for 40 minutes. The resulting mixture was left overnight, shaken again at 200 rpm for 40 minutes, and allowed to stand. The supernatant was used as a measurement solution (by 10-fold diluting it with methanol for the GC measurement).

The measurement solution was analyzed by the GC-FID and quantified by the calibration curve method.

GC-FID; 6890N gas chromatograph, manufactured by Agilent

Column; DB-WAX 30 m×530 μm×1 μm

Constant Pressure mode 5.5 psi (velocity; 50 cm/sec)

Injection; 1.0 μL

Inlet; Spritless mode 250° C. 5.5 psi

Oven; 80° C.→(10° C./min)→170° C. (hold 6.0 min) [Max 220° C.]

Detector; FID detector 250° C. (H2; 40 mL/min air; 450 mL/min)

Signal rate; 20 Hz

Concentrations of calibration curve solutions; eight points of 0, 0.01, 0.05, 0.1, 0.3, 0.5, 0.7 and 1.0 [mg-menthol/mL]

The menthol content (mg) of the prepared menthol-containing sheet and the menthol content (mg) of the menthol-containing sheet stored in the accelerated environments were measured. The results are shown in Table 1 as the "initial menthol content (%)" and the "post-storage menthol content (%)".

Initial menthol content (%)={measured value of the menthol content (mg)/weight of the menthol-containing sheet (mg)}×100

Post-storage menthol content (%)={measured value of the menthol content (mg)/weight of the menthol-containing sheet (mg)}×100

The accelerated environments were as follows.

About 5 g of a menthol-containing sheet (cut into 1×10 mm pieces) was placed in an open container, and it was stored for a maximum of 30 days in a thermostat (Drying Oven DX600, Yamato Scientific Co., Ltd.) set at 50° C.

The menthol flavor retention rate was calculated from the value of the menthol content using the following equation, and the flavor retention ability of the menthol-containing sheet was evaluated.

Menthol flavor retention rate (%)={(post-storage menthol content)/(initial menthol content)}×100

(5) Results

The menthol-containing sheets of Sample Nos. 1 to 4 were prepared with the hot air drying machine under the hot air drying conditions described in Table 1. The moisture content and initial menthol content of the menthol-containing sheets were measured according to the above procedure. The results are shown in Table 1. The menthol content of the sheet stored for 30 days is shown in Table 1. The menthol content of the sheet stored for 7 days, 14 days and 30 days is shown in FIG. 1. The reference numerals 1 to 7 in FIG. 1 represent Sample Nos. 1 to 7.

TABLE 1

| Sample Nos. | 1 | 2 | 3 | 4 |
|---|---|---|---|---|
| Hot air drying conditions | | | | |
| First chamber | 70° C. · 4 min | 120° C. · 2 min | 70° C. · 20 min | 120° C. · 2.5 min |
| Second chamber | 80° C. · 4 min | 130° C. · 2 min | 70° C. · 20 min | 120° C. · 2.5 min |
| Third chamber | 120° C. · 4 min | 176° C. · 2 min | 70° C. · 20 min | 70° C. · 2.5 min |
| Belt speed | 0.6 m/min | 1.3 m/min | 0.13 m/min | 1.0 m/min |
| Moisture content | 3.1% | 3.2% | 3.1% | 3.4% |
| Initial menthol content | 81.5% | 62.4% | 75.8% | 75.7% |
| Post-storage menthol content | 13.6% (20 days later) | 29.2% (30 days later) | 59.2% (30 days later) | 62.4% (30 days later) |
| Flavor retention rate | 17% | 47% | 78% | 82% |

Sample No. 1

When the raw material slurry is extended and dried with the hot air drying machine to form a sheet shape, in many cases, hot air drying is started at a low temperature (about 70° C.) so as not to form a surface coating in the first-half drying, and the hot air drying is continued at a high temperature (about 120° C.) so as to achieve the complete drying in the second-half drying. In accordance with this drying procedure, the menthol-containing sheet of Sample No. 1 was prepared, and as a result, a sufficiently dried sample (moisture content: 3.1%) can be prepared for a total drying time of 12 minutes. The "initial menthol content" after sheet preparation was as high as 81.5%, but the "post-storage menthol content" after stored (for 20 days) in the accelerated environments was as low as 13.6%. Thus, the sheet of Sample No. 1 had a problem in a post-storage flavor-retaining property.

Sample No. 2

In Sample No. 2, high drying temperatures were employed to make the drying time shorter than that of Sample No. 1. As a result, in Sample No. 2, a sufficiently dried sample (moisture content: 3.2%) can be prepared for a total drying time of 6 minutes. The "initial menthol content" after sheet preparation was as high as 62.4%, but the "post-storage menthol content" after stored (for 30 days) in the accelerated environments was as low as 29.2%. Thus, the sheet of Sample No. 2 had a problem in a post-storage flavor-retaining property.

Sample No. 3

In Sample No. 3, the hot air temperature was set to 70° C. in the whole period of the drying step. As a result, in Sample No. 3, a sufficiently dried sample (moisture content: 3.1%) can be prepared for a total drying time of 60 minutes. The "initial menthol content" after sheet preparation was as high as 75.8%, and the "post-storage menthol content" after stored (for 30 days) in the accelerated environments was also as high as 59.2%. Thus, both of flavor-retaining property after sheet preparation and post-storage flavor-retaining property were excellent. However, the time required for drying was as long as 60 minutes.

Sample No. 4

In Sample No. 4, in contrast to Sample Nos. 1 and 2 in which the low temperature drying was shifted to the high temperature drying, the initial drying (in the first and second chambers) was performed by hot air at a high temperature (120° C.) and the latter drying (in the third chamber) was performed by hot air at a low temperature (70° C.). In Sample No. 4, the total drying time was as short as 7.5 minutes, however a sufficiently dried sample (moisture content: 3.4%) can be prepared. The "initial menthol content" after sheet preparation was as high as 75.7%, and the "post-storage menthol content" after stored (for 30 days) in the accelerated environments was also as high as 62.4%. Thus, both of flavor-retaining property after sheet preparation and post-storage flavor-retaining property were excellent. The results show that it was possible to prepare a sheet having an excellent flavor-retaining property in a relatively short drying time, if the initial high temperature drying and the latter low temperature drying were employed.

Example 2

The menthol-containing sheet of Sample No. 5 was prepared in a similar manner to that of Example 1, except that the slurry was dried under the hot air drying conditions described in Table 2 below, and the moisture content and the menthol content were measured. The results are shown in Table 2.

TABLE 2

| Sample No. | 5 |
|---|---|
| Hot air drying conditions | |
| First chamber | 120° C. · 4 min [Floating jet 20 m/sec] |
| Second chamber | 70° C. · 4 min [Jet 20 m/sec] |
| Third chamber | 70° C. · 4 min [Jet 10 m/sec] |
| Belt speed | 0.6 m/min |
| Moisture content | 3.1% |
| Initial menthol content | 72.7% |
| Post-storage menthol content | 58.5% |
| Flavor retention rate | 80% |

In Sample No. 5, the volume of the hot air was increased as compared to those of Sample Nos. 1 to 4. In the first chamber, hot air was blown on the menthol-containing sheet which was conveyed while floating by upward and downward ventilation. In the second and third chambers, hot air was blown on the menthol-containing sheet which was conveyed on the belt by ventilation.

In Sample No. 5, the initial drying (in the first chamber) was performed by hot air at a high temperature (120° C.) for 4 minutes and the latter drying (in the second and third chambers) was performed by hot air at a low temperature (70° C.) for 8 minutes. In Sample No. 5, a sufficiently dried sample (moisture content: 3.1%) can be prepared for a total drying time of 12 minutes. The "initial menthol content" after sheet preparation was as high as 72.7%, and the "post-storage menthol content" after stored (for 30 days) in the accelerated environments was also as high as 58.5%. Thus, both of flavor-retaining property after sheet preparation and post-storage flavor-retaining property were excellent. The results show that it was possible to prepare a sheet having an excellent flavor-retaining property in a relatively short drying time, if the initial high temperature drying and the latter low temperature drying were employed.

Example 3

The menthol-containing sheets of Sample Nos. 6 and 7 were prepared in a similar manner to that of Example 1, except that the slurry was dried using a hot air drying machine having four chambers of drying compartment under the hot air drying conditions described in Table 3 below, and the moisture content and the menthol content were measured. The results are shown in Table 3.

TABLE 3

| Sample Nos. | 6 | 7 |
|---|---|---|
| Hot air drying conditions | | |
| First chamber | 110° C. · 2.2 min [Jet 10 m/sec] | 100° C. · 2.2 min [Jet 10 m/sec] |
| Second chamber | 100° C. · 2.2 min [Jet 10 m/sec] | 100° C. · 2.2 min [Jet 10 m/sec] |
| Third chamber | 100° C. · 2.2 min [Jet 10 m/sec] | 100° C. · 2.2 min [Jet 10 m/sec] |
| Fourth chamber | 80° C. · 2.2 min [Jet 10 m/sec] | 100° C. · 2.2 min [Jet 10 m/sec] |
| Belt speed | 0.9 m/min | 0.9 m/min |
| Moisture content | 5% | 4.9% |
| Initial menthol content | 63.5% | 61.9% |
| Post-storage menthol content | 59.9% (30 days later) | 60.8% (30 days later) |
| Flavor retention rate | 94% | 98% |

In Sample Nos. 6 and 7, menthol-containing sheets were prepared using a hot air drying machine having four chambers of drying compartment.

In Sample No. 6, the initial drying (in the first to third chambers) was performed by hot air at a high temperature (110° C.→100° C.) for 6.6 minutes, and the latter drying (in the fourth chamber) was performed by hot air at a low temperature (80° C.) for 2.2 minutes. In Sample No. 6, a sufficiently dried sample (moisture content: 5%) can be prepared for a total drying time of 8.8 minutes. The "initial menthol content" after sheet preparation was as high as 63.5%, and the "post-storage menthol content" after stored (for 30 days) in the accelerated environments was also as high as 59.9%. Thus, both of flavor-retaining property after sheet preparation and post-storage flavor-retaining property were excellent. The results show that it was possible to prepare a sheet having an excellent flavor-retaining property in a relatively short drying time by employing the initial high temperature drying and the latter low temperature drying, though the hot air temperature sequentially is reduced from 110° C. to 100° C. during the initial drying.

In Sample No. 7, the hot air temperature was set to 100° C. in the whole period of the drying step, regardless of the initial drying and the latter drying. In Sample No. 7, the latter drying at a low temperature was not employed, but it is assumed that the sample temperature did not become too high in the process of drying the slurry due to the presence of the moisture in the sample, similarly to Sample Nos. 4 to 6. Specifically, in Sample No. 7, a sufficiently dried sample (moisture content: 4.9%) can be prepared for a total drying time of 8.8 minutes. The "initial menthol content" after sheet preparation was as high as 61.9%, and the "post-storage menthol content" after stored (for 30 days) in the accelerated environments was also as high as 60.8%. Thus, both of flavor-retaining property after sheet preparation and post-storage flavor-retaining property were excellent. The results show that it was possible to prepare a sheet having an excellent flavor-retaining property in a relatively short drying time, similarly to the cases of Sample Nos. 4 to 6, though the same hot air temperature (100° C.) was employed in the whole period of the drying step.

Example 4

In this example, temperature-responsive sol-gel transition characteristics of a polysaccharide solution (slurry) were examined.

Water 0.1 L

Gellan gum (KELCOGEL, San-Ei Gen F.F.I., Inc.) 5 g

Water (0.1 L) was kept at 70° C., and gellan gum (5 g) was added and dissolved therein in small portions so as not to form lumps, while stirring them using a high-performance mixer DMM (ATEC Japan Co., Ltd.), and a polysaccharide solution (slurry) was prepared.

Figure 2A:
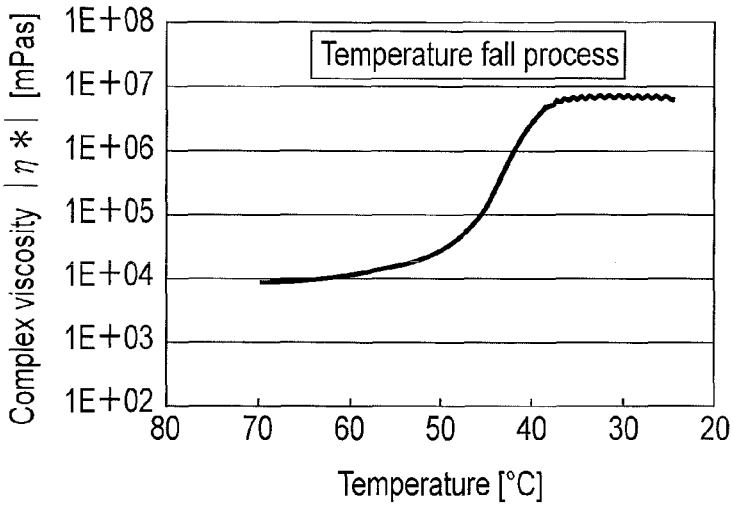
FIG. 2A is a graph showing changes in the viscosity followed by a fall in the temperature of aqueous gellan gum solution.
Figure 2B:
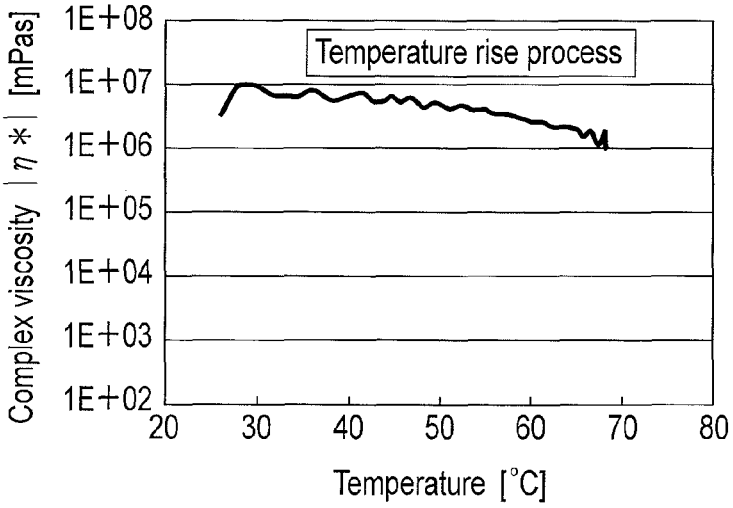
FIG. 2B is a graph showing changes in the viscosity followed by a rise in the temperature of aqueous gellan gum solution.

The temperature of the obtained slurry (70° C.) was decreased to 25° C. for about 900 seconds (0.05° C./sec.). Thereafter, the temperature was raised to 70° C. for about 900 seconds. FIGS. 2A and 2B show how the viscosity (fluidity) of the slurry was changed by the temperature change.

As shown in FIG. 2A, if the temperature of the slurry was decreased to 25° C. (cooling), the viscosity was low up to a temperature of 50° C. (the fluidity was high). However, the viscosity was suddenly increased at 40° C. or less (gelation phenomenon). If the temperature of the obtained gel was raised, the gel did not easily return to a sol state even if the temperature exceeded the gelation temperature (40° C.), as shown in FIG. 2B. Thus, the gel state was maintained up to a considerably high temperature.

The result shows that once the slurry containing polysaccharide is cooled and forms gel, the slurry is hard to return to a sol state even if the temperature is raised afterward, and thus the gel state can be maintained. The above property of the polysaccharide is utilized in the present invention, and the preliminary cooling is performed before drying the raw material slurry. As a result, it is expected that the polysaccharide contained in the raw material slurry after the preliminary cooling is hard to solate even if the temperature is raised at the time of drying, and the menthol coated with the polysaccharide is hard to volatilize.

Example 5

In this example, the sheets of Sample Nos. 1 to 7 were prepared as described in the Examples 1 to 3, and the temperature of the samples was measured during the drying step. Regarding the hot air drying conditions of the samples of Sample Nos. 1 to 7, it can be referred to Tables 1 to 3.

The measurement of the sample temperature was performed by directly measuring each sample (slurry) in the middle of the drying step using a non-contact thermometer (PT-7LD, manufactured by, OPTEX CO., LTD).

The measurement results of Sample Nos. 1 to 7 are shown in FIGS. 3A to 3G, respectively. In FIGS. 3A to 3G, the term "Cooling" means a sample prepared by blowing cold air (10° C.) on a slurry before the drying step and cooling to about 20° C., while the term "No cooling" means a sample prepared by casting a slurry and immediately drying it without performing the cooling process. The results of FIGS. 3A to 3G show that the cooling of the slurry does not affect on the temperature of each sample during the drying step.

Figure 3A:
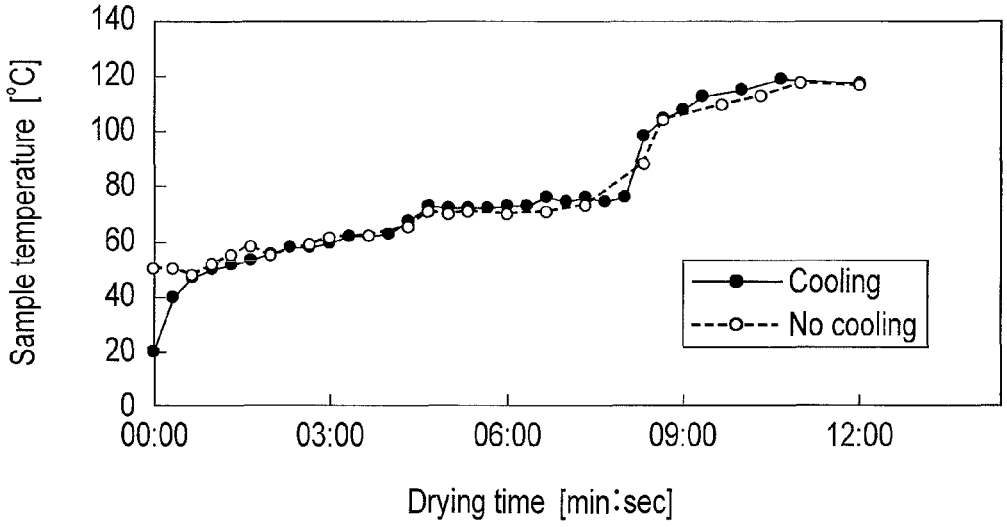
FIG. 3A is a graph showing the sample temperature of Sample No. 1 during the heat-drying step.

In Sample No. 1, the following hot air drying conditions were employed: at a hot air temperature of 70° C. for 4 minutes, at a hot air temperature of 80° C. for 4 minutes, and at a hot air temperature of 120° C. for 4 minutes. The sample temperature increased following a rise in hot air temperature. Finally, it exceeded 100° C. and reached nearly 120° C. (FIG. 3A). As shown, the "post-storage menthol content" of the sheet of Sample No. 1 is as low as 13.6% (Table 1). It is estimated that the internal structure of the sheet was destroyed by the high sample temperature and thus the post-storage menthol content was reduced.

Figure 3B:
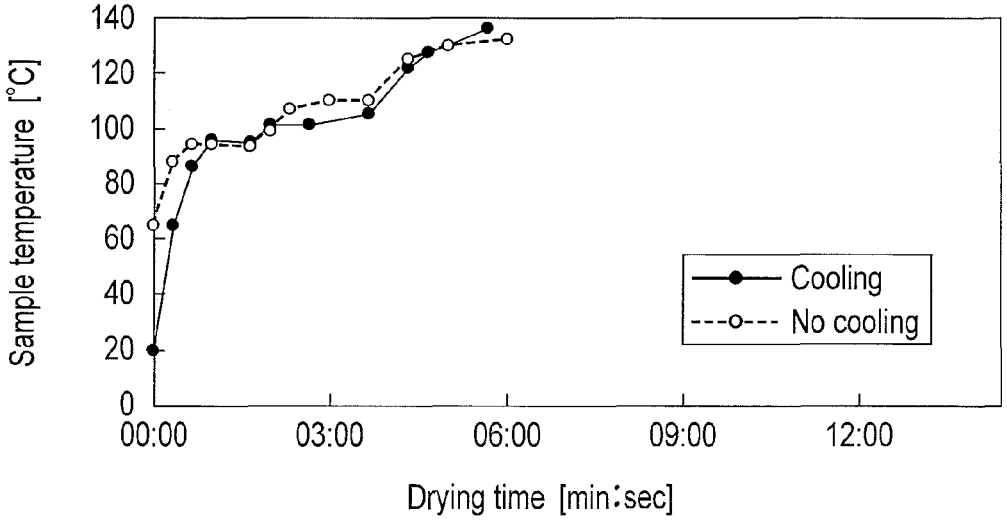
FIG. 3B is a graph showing the sample temperature of Sample No. 2 during the heat-drying step.

In Sample No. 2, the following hot air drying conditions were employed: at a hot air temperature of 120° C. for 2 minutes, at a hot air temperature of 130° C. for 2 minutes, and at a hot air temperature of 176° C. for 2 minutes. The sample temperature increased following a rise in hot air temperature. Finally, it exceeded 100° C. and reached nearly 140° C. (FIG. 3B). As shown, the "post-storage menthol content" of the sheet of Sample No. 2 is as low as 29.2% (Table 1). It is estimated that the internal structure of the sheet was destroyed by the high sample temperature and thus the post-storage menthol content was reduced.

Figure 3C:
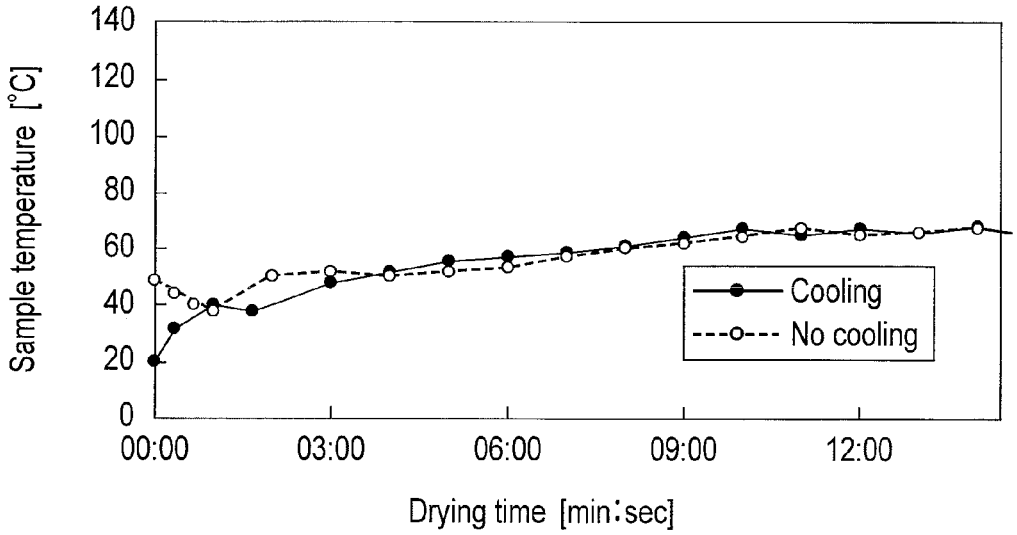
FIG. 3C is a graph showing the sample temperature of Sample No. 3 during the heat-drying step.

In Sample No. 3, the hot air drying at a hot air temperature of 70° C. for 60 minutes was employed as the hot air drying conditions. FIG. 3C shows the sample temperature from the start of drying to 14 minutes after drying. The sample temperature did not exceed 70° C. over the total drying time. As shown, the "post-storage menthol content" of the sheet of Sample No. 3 is as high as 59.2% (Table 1). It is estimated that the sheet of Sample No. 3 did not reach a high temperature over the total drying time and thus the high menthol content can be maintained after storage in the accelerated environments. However, the sheet of Sample No. 3 was dried at a sample temperature of less than 70° C., and thus 60 minutes were necessary for the drying.

Figure 3D:
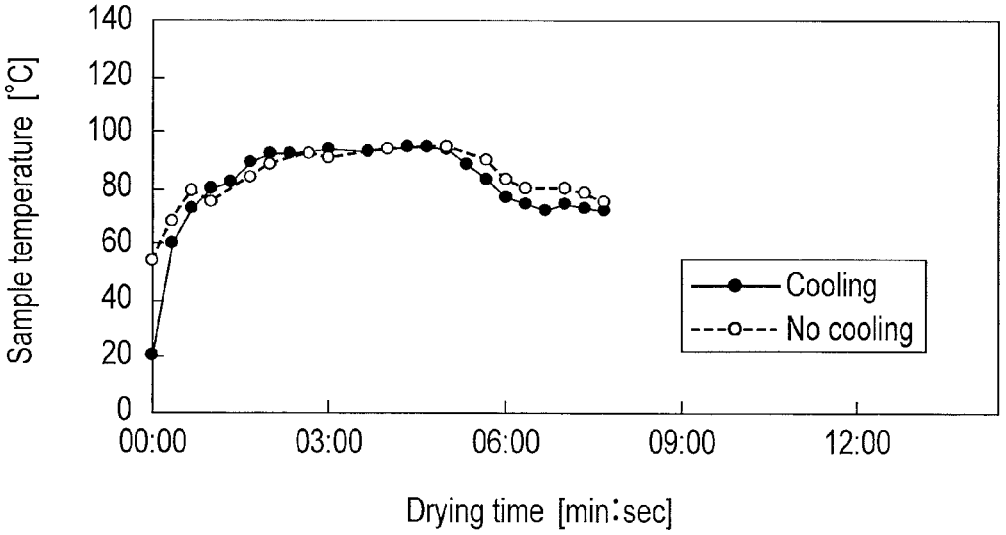
FIG. 3D is a graph showing the sample temperature of Sample No. 4 during the heat-drying step.

In Sample No. 4, the following hot air drying conditions were employed: at a hot air temperature of 120° C. for 5 minutes and at a hot air temperature of 70° C. for 2.5 minutes. The sample temperature reached up to 95° C. under the hot air of 120° C., and decreased to 72° C. under the hot air of 70° C. (FIG. 3D). As shown, the "post-storage menthol content" of the sheet of Sample No. 4 is as high as 62.4% (Table 1). It is estimated that the sheet of Sample No. 4 was kept at a sample temperature lower than those of Sample Nos. 1 and 2 over the total drying time and thus the high menthol content can be maintained after storage in the accelerated environments.

Figure 3E:
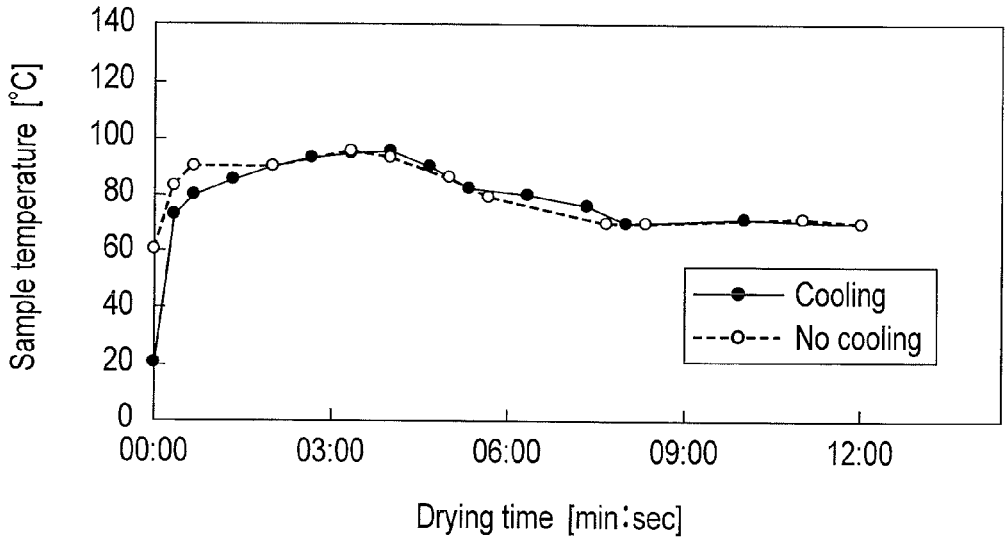
FIG. 3E is a graph showing the sample temperature of Sample No. 5 during the heat-drying step.

In Sample No. 5, the following hot air drying conditions were employed: at a hot air temperature of 120° C. for 4 minutes and at a hot air temperature of 70° C. for 8 minutes. The sample temperature reached up to 95° C. under the hot air of 120° C., and decreased to 70° C. under the hot air of 70° C. (FIG. 3E). As shown, the "post-storage menthol content" of the sheet of Sample No. 5 is as high as 58.5% (Table 2). It is estimated that the sheet of Sample No. 5 was kept at a sample temperature lower than those of Sample Nos. 1 and 2 over the total drying time and thus the high menthol content can be maintained after storage in the accelerated environments.

Figure 3F:
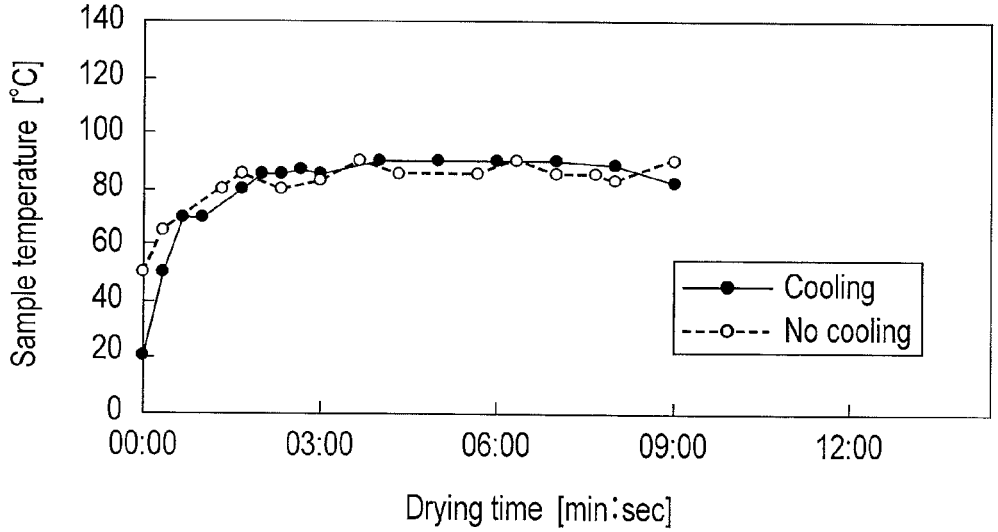
FIG. 3F is a graph showing the sample temperature of Sample No. 6 during the heat-drying step.

In Sample No. 6, the following hot air drying conditions were employed: at a hot air temperature of 110° C. for 2.2 minutes, at a hot air temperature of 100° C. for 4.4 minutes, and at a hot air temperature of 80° C. for 2.2 minutes. The sample temperature was maintained within a range of about 80 to 90° C. (FIG. 3F). As shown, the "post-storage menthol content" of the sheet of Sample No. 6 is as high as 59.9% (Table 3). It is estimated that the sheet of Sample No. 6 was kept at a sample temperature lower than those of Sample Nos. 1 and 2 over the total drying time and thus the high menthol content can be maintained after storage in the accelerated environments.

Figure 3G:
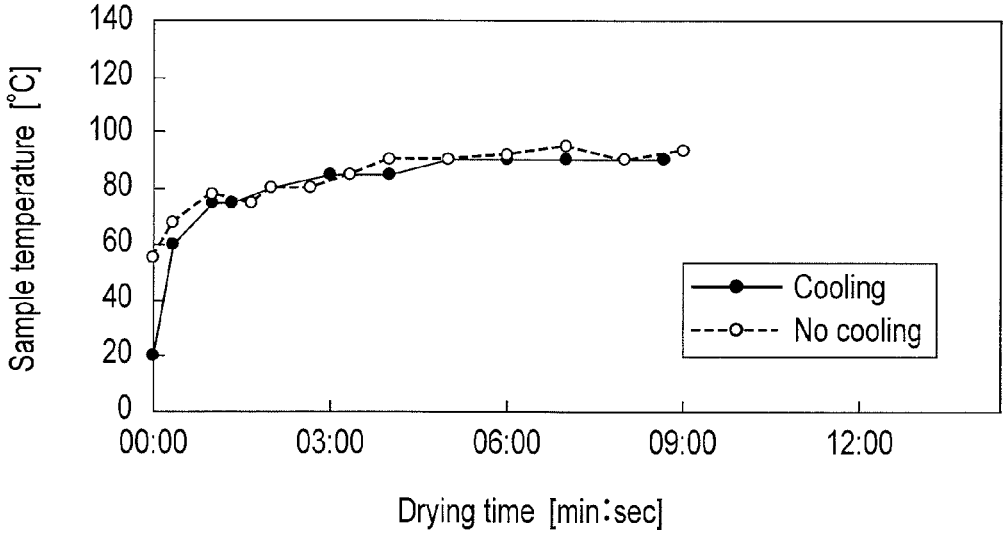
FIG. 3G is a graph showing the sample temperature of Sample No. 7 during the heat-drying step.

In Sample No. 7, the hot air drying at a hot air temperature of 100° C. for 8.8 minutes were employed as the hot air drying conditions. The sample temperature was maintained within a range of about 80 to 90° C. (FIG. 3G). As shown, the "post-storage menthol content" of the sheet of Sample No. 7 is as high as 60.8% (Table 3). It is estimated that the sheet of Sample No. 7 was kept at a sample temperature lower than those of Sample Nos. 1 and 2 over the total drying time and thus the high menthol content can be maintained after storage in the accelerated environments.

The above results show that if the slurry is dried at a sample temperature which does not exceed 100° C. over the total drying time, a high "post-storage menthol content" can be maintained. Further, it is found that if the slurry is dried at a sample temperature of 70 to 100° C. over the total drying time (except for about 1 minute at the beginning of the drying time), it is possible to form a menthol-containing sheet in a shorter time.

Example 6

In this example, it is demonstrated that the slurry cooling process before the drying step has an effect on the "post-storage menthol content" of the menthol-containing sheets. Specifically, the sheets of Sample Nos. 1 to 7 were prepared as described in Examples 1 to 3. In each of the sheets of Sample Nos. 1 to 7, the "post-storage menthol content" of the sheet prepared through the slurry cooling process was compared with the "post-storage menthol content" of the sheet prepared without the slurry cooling process. As described in Example 1, each sheet was stored in the thermostat set at 50° C. for 7, 14, and 30 days.

The measurement results of Sample Nos. 1 to 3 are shown in FIG. 4A and the measurement results of Sample Nos. 4 to 7 are shown in FIG. 4B. In FIGS. 4A and 4B, the term "Cooling" means a sample prepared by blowing cold air (10° C.) on a slurry before the drying step and cooling to about 20° C., while the term "No cooling" means a sample prepared by casting a slurry and immediately drying it without performing the cooling process. In the samples of "No cooling", the slurry temperature was not less than 50° C. during the casting and drying of the slurry.

The data of "Cooling" in FIGS. 4A and 4B are the same as those in FIG. 1.

In the sheets of Sample Nos. 1 and 2, the menthol content after storage for 30 days was low without reaching 30%, regardless of the presence or absence of the cooling process.

In the sheets of Sample No. 3, the menthol content after storage for 30 days was greater than 50%, regardless of the presence or absence of the cooling process. However, the drying time of 60 minutes was necessary for preparing the sheet of Sample No. 3.

In the sheets of Sample No. 4, the menthol content after storage for 30 days was decreased to 18% in the case of "No cooling", while the menthol content after storage for 30 days was maintained to 62% in the case of "Cooling".

In the sheets of Sample No. 5, the menthol content after storage for 30 days was decreased to 20% in the case of "No cooling", while the menthol content after storage for 30 days was maintained to 59% in the case of "Cooling".

In the sheets of Sample No. 6, the menthol content after storage for 30 days was decreased to 20% in the case of "No cooling", while the menthol content after storage for 30 days was maintained to 60% in the case of "Cooling".

In the sheets of Sample No. 7, the menthol content after storage for 30 days was decreased to 12% in the case of "No cooling", while the menthol content after storage for 30 days was maintained to 61% in the case of "Cooling".

The above results show that when the raw material slurry is once cooled and dried at a sample temperature of 70 to 100° C. to prepare a menthol-containing sheet, it is possible to form the sheet in a shorter time and keep the post-storage menthol content high.

Example 7

In this example, a relationship between the cooling temperature of the slurry and the "initial menthol content" of the menthol-containing sheets was examined. Specifically, in the sheet of Sample No. 6 described in Example 3, the cooling temperature of the slurry was changed to 20° C., 30° C., 40° C., 50° C., and 60° C., and various sheets were prepared. The menthol content of the sheet immediately after preparation, i.e., "initial menthol content" was measured.

The measurement results are shown in FIG. 5. From the results of FIG. 5, it was observed that the menthol content of the sheet tended to increase as the cooling temperature was lower. Specifically, the sheets showed the following initial menthol content: 64% when the cooling temperature was 20° C., 61% when the cooling temperature was 30° C., 57% when the cooling temperature was 40° C., 52% when the cooling temperature was 50° C., and 43% when the cooling temperature was 60° C.

In Example 4 described above, it is shown that the slurry forms gel at a cooling temperature of 40° C. or less, and that once the slurry containing polysaccharide is cooled and forms gel, the slurry is hard to return to a sol state even if the temperature is raised afterward. Further, it is generally known that if the temperature of the emulsion is less than 0° C., the emulsion is frozen and destroyed.

From these results, it is found that cooling temperatures is preferably 0 to 40° C., more preferably 0 to 30° C.

Example 8

In this example, a relationship between the moisture content of the menthol-containing sheets and the menthol flavor retention rate was examined. Specifically, in the sheet of Sample No. 6 described in Example 3, the total drying time of the slurry was changed to 8.16 minutes, 7.92 minutes, 7.64 minutes, 7.44 minutes, and 7.08 minutes by increasing the conveying speed of the belt in the hot air drying machine, and sheets having various moisture contents were prepared. The moisture content of the prepared sheets was measured. The preparation conditions and moisture content of the sheets are shown in Table 4 below.

TABLE 4

| Sample Nos. | 8-1 | 8-2 | 8-3 | 8-4 | 8-5 |
|---|---|---|---|---|---|
| Belt conveying speed | 1.13 m/min | 1.07 m/min | 1.04 m/min | 1.01 m/min | 0.98 m/min |
| Total drying time | 7.08 min | 7.44 min | 7.64 min | 7.92 min | 8.16 min |
| Moisture content after drying | 22.6 wt % | 14.6 wt % | 11.2 wt % | 8.6 wt % | 6.1 wt % |

The prepared sheets were stored in the thermostat set at 50° C. for 30 days as described in Example 1. The menthol content was measured as to the sheets immediately after preparation and the sheets after storage. The measurement results are shown in Table 5 below as "the initial menthol content" and "the menthol content of the sheets stored immediately after preparation". The menthol flavor retention rate was calculated from the values of the menthol content using Equation below.

$$\text{Menthol flavor retention rate (\%)}=\{(\text{post-storage menthol content})/(\text{initial menthol content})\}\times 100$$

Figure 6:
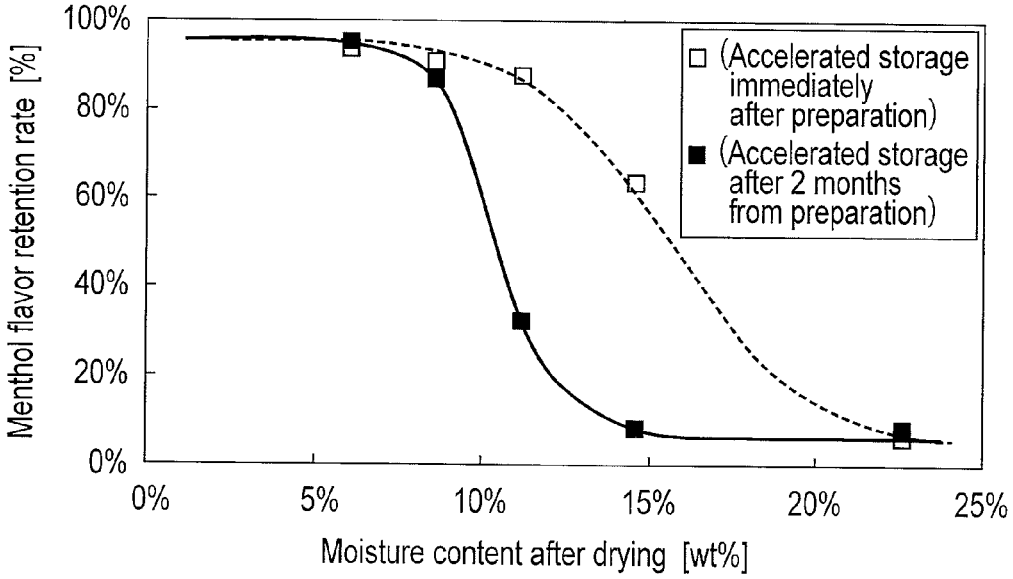
FIG. 6 is a graph showing a relationship between the moisture content of the menthol-containing sheets and the menthol flavor retention rate.

The results are shown in FIG. 6 as "the accelerated storage immediately after preparation".

Further, the sheets were allowed to stand for 2 months after preparation, and they were stored in the thermostat set at 50° C. for 30 days as described in Example 1. The menthol content was measured as to the sheets immediately after preparation and the sheets after storage. The measurement results are shown in Table 5 below as "the initial menthol content" and "the menthol content of the sheets stored after 2 months from preparation". The menthol flavor retention rate was calculated by the above equation. The results are shown in FIG. 6 as "the accelerated storage after 2 months from preparation".

In the experiments in which the sheets after 2 months from preparation were stored in the accelerated environments, the following results were shown: the sheet (Sample No. 8-5) having a moisture content of about 6% had a menthol flavor retention rate of 95%, the sheet (Sample No. 8-4) having a moisture content of about 9% had a menthol flavor retention rate of 87%, the sheet (Sample No. 8-3) having a moisture content of about 11% had a menthol flavor retention rate of 32%, the sheet (Sample No. 8-2) having a moisture content of about 15% had a menthol flavor retention rate of 8%, and the sheet (Sample No. 8-1) having a moisture content of about 23% had a menthol flavor retention rate of 8%.

These results show that if the moisture content of the sheet becomes high, the menthol flavor retention rate is suddenly decreased, and thus the sheet is preferably dried so that the moisture content of the sheet is less than 10%, preferably 9% or less. Particularly, it is found that even if the sheet after 2 months from preparation is further stored in the accelerated environments, it is possible to maintain a high menthol flavor retention rate by lowering the moisture content of the sheet to about 9% or less.

When the moisture content of the sheet is decreased to less than 3%, the menthol flavor retention rate is excellent.

TABLE 5

| Sample Nos. | 8-1 | 8-2 | 8-3 | 8-4 | 8-5 |
|---|---|---|---|---|---|
| Moisture content after drying | 22.6 wt % | 14.6 wt % | 11.2 wt % | 8.6 wt % | 6.1 wt % |
| Initial menthol content | 51.0% | 56.5% | 59.5% | 62.2% | 61.0% |
| Menthol content of sheets stored immediately after preparation | 3.0% | 35.6% | 51.9% | 56.3% | 56.8% |
| Menthol content of sheets stored after 2 months from preparation | 3.9% | 4.4% | 18.1% | 50.2% | 56.8% |

The menthol content of the sheet immediately after preparation was about 50 to 60% in all the cases of Sample Nos. 8-1 to 8-5.

In the experiments in which the sheets immediately after preparation were stored in the accelerated environments, the following results was shown: the sheet (Sample No. 8-5) having a moisture content of about 6% had a menthol flavor retention rate of 93%, the sheet (Sample No. 8-4) having a moisture content of about 9% had a menthol flavor retention rate of 90%, the sheet (Sample No. 8-3) having a moisture content of about 11% had a menthol flavor retention rate of 87%, the sheet (Sample No. 8-2) having a moisture content of about 15% had a menthol flavor retention rate of 63%, and the sheet (Sample No. 8-1) having a moisture content of about 23% had a menthol flavor retention rate of 6%.

However, "cracking" or "peeling" occurs on the sheet in this case. Thus, the moisture content of the sheet after drying is preferably 3% or more.

What is claimed is:

1. A method for preparing a flavor-containing sheet for a smoking article, comprising:

a step of extending a raw material slurry on a substrate, wherein the slurry contains polysaccharide and a flavor, has a moisture content of 70 to 95 wt %, and has a temperature of 60 to 90° C. in a sol state;

a step of cooling the extended raw material slurry to a sample temperature of 0 to 40° C. to form a gel; and a heat-drying step comprising drying the gelled raw material by heating it at a sample temperature of 70 to 100° C.

2. The method for preparing a flavor-containing sheet for a smoking article according to claim 1, wherein the heat-drying step is performed so that the sample temperature is kept at 100° C. or less during the whole period of the step.

3. The method for preparing a flavor-containing sheet for a smoking article according to claim 1, wherein the heat-drying step is performed so that the raw material is dried to form a sheet having a moisture content of less than 10% for a total heat-drying time of 20 minutes or less.

4. The method for preparing a flavor-containing sheet for a smoking article according to claim 1, wherein the heat-drying step is performed so that the raw material is dried to form a sheet having a moisture content of less than 10% for a total heat-drying time of 20 minutes or less, by performing initial drying for a quarter or more of the total heat-drying time by blowing the hot air of 100° C. or more on the gelled raw material and performing the latter drying for a quarter or more of the total heat-drying time by blowing the hot air less than 100° C. on the gelled raw material.

5. The method for preparing a flavor-containing sheet for a smoking article according to claim 1, wherein the flavor content of the sheet after preparation is 45 wt % or more, and the flavor content of the sheet after storage at 50° C. for 30 days is 45 wt % or more.

6. The method for preparing a flavor-containing sheet for a smoking article according to claim 1, wherein the flavor is menthol.

7. The method for preparing a flavor-containing sheet for a smoking article according to claim 6, wherein the menthol content of the sheet after preparation is 45 wt % or more, and the menthol content of the sheet after storage at 50° C. for 30 days is 45 wt % or more.

8. The method for preparing a flavor-containing sheet for a smoking article according to claim 1, wherein the heat-drying step is performed for a total heat-drying time of 20 minutes or less.

* * * * *